United States Patent [19]

Weil et al.

[11] 4,003,821

[45] Jan. 18, 1977

[54] PROCESS FOR PRODUCTION OF HYDROCARBON LIQUID FROM OIL SHALE

[75] Inventors: Sanford A. Weil, Chicago; Paul B. Tarman, Elmhurst; Dharamvir Punwani, Bolingbrook, all of Ill.

[73] Assignee: Institute of Gas Technology, Chicago, Ill.

[22] Filed: Aug. 18, 1975

[21] Appl. No.: 605,411

Related U.S. Application Data

[63] Continuation-in-part of Ser. No. 409,915, Oct. 26, 1973, abandoned, and a continuation-in-part of Ser. No. 339,547, March 9, 1973, Pat. No. 3,891,403.

[52] U.S. Cl. ..... 208/11 R

[51] Int. Cl.[2] ..... C10G 1/02

[58] Field of Search ..... 208/11 R

[56] References Cited

UNITED STATES PATENTS

| | | | |
|---|---|---|---|
| 2,710,828 | 6/1955 | Scott et al. | 208/11 R |
| 2,832,725 | 4/1958 | Scott | 208/11 R |
| 3,484,364 | 12/1969 | Hemminger | 208/11 R |
| 3,503,869 | 3/1970 | Haddad et al. | 208/11 R |
| 3,617,468 | 11/1971 | Reyburn et al. | 208/11 R |
| 3,634,225 | 1/1972 | Garbett | 208/11 R |
| 3,891,404 | 6/1975 | Weil et al. | 48/213 |
| 3,922,215 | 11/1975 | Linden et al. | 208/11 R |
| 3,929,615 | 12/1975 | Linden et al. | 208/11 R |

*Primary Examiner*—D. Horwitz
*Assistant Examiner*—James W. Hellwege
*Attorney, Agent, or Firm*—Thomas W. Speckman

[57] ABSTRACT

A process for producing hydrocarbon liquids in preference to gases from oil shale. The shale is introduced at the top of a reaction chamber which includes an upper oil shale preheat zone having a temperature not more than about 950° F., a hydroretort reaction zone at a temperature of about 850° to about 1250° F. and a lower hydrogen preheat zone to recover heat from spent shale. Solids from the shale are passed downwardly through the chamber so that the shale, and particularly the oil therein, is gradually heated to the reaction temperature over a relatively extended period of at least ten minutes so as to inhibit the formation of a carbon residue. A hydrogen-rich gas, containing hydrogen in excess of stoichiometric amounts needed for the hydroretorting of the oil in the shale, is passed upwardly in the reaction chamber and countercurrent to the shale solids passing downwardly therethrough. A hydroretorting reaction is promoted in the reaction chamber between the oil or organic material in the shale and the hydrogen so as to produce predominately distillable hydrocarbon liquids and a low proportion of low molecular weight paraffinic hydrocarbon gases. The process can be controlled to maximize production of aliphatic and alicyclic hydrocarbon liquids which may be utilized for wide variety of purposes including gasificaton for the production of synthetic pipeline-quality gas from oil shale.

12 Claims, 1 Drawing Figure

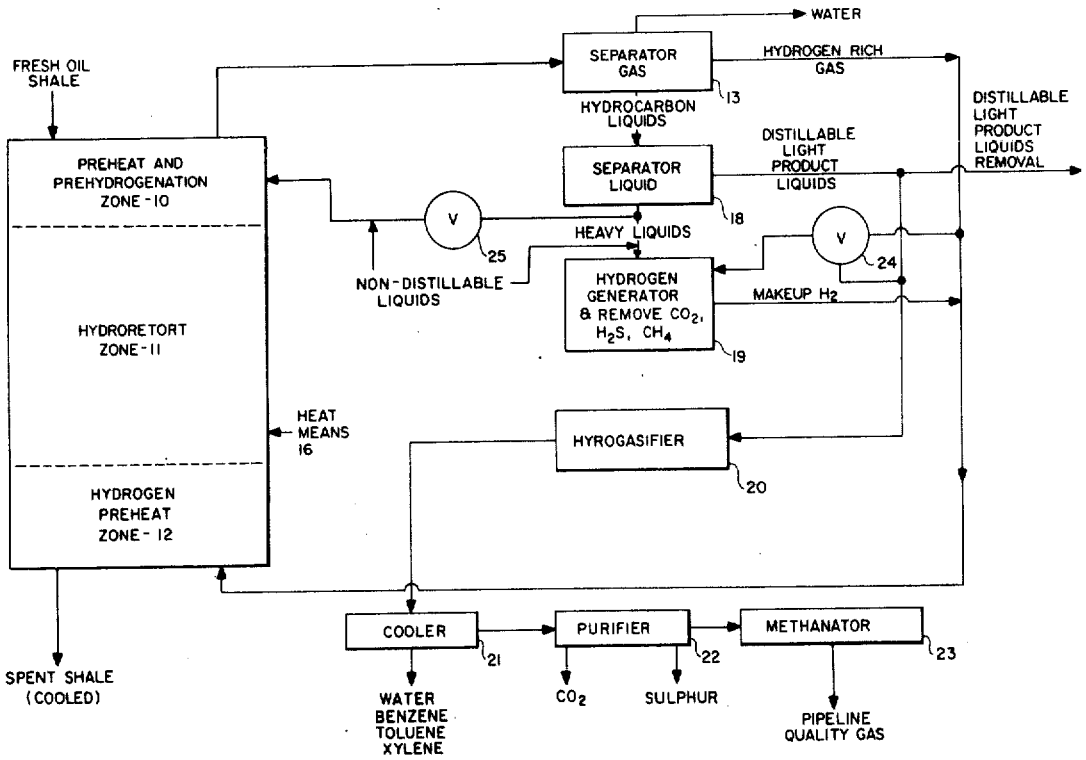

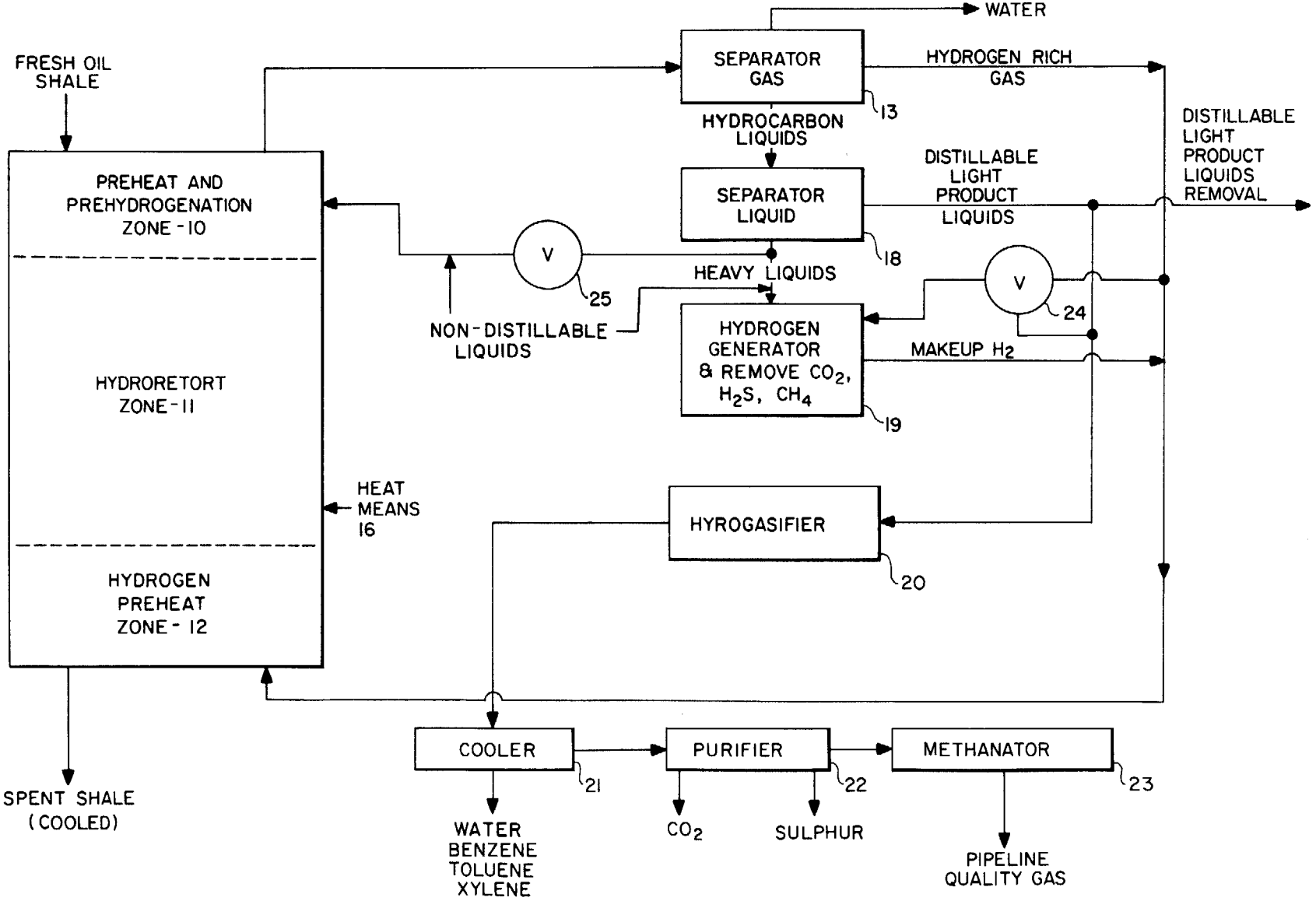
DISTILLABLE LIGHT PRODUCT LIQUIDS REMOVAL
WATER
HYDROGEN RICH GAS
DISTILLABLE LIGHT PRODUCT LIQUIDS
MAKEUP H2
24
13
18
19
20
23
SEPARATOR GAS
HYDROCARBON LIQUIDS
SEPARATOR LIQUID
HEAVY LIQUIDS
HYDROGEN GENERATOR & REMOVE CO2, H2S, CH4
HYROGASIFIER
METHANATOR
PIPELINE QUALITY GAS
22
PURIFIER
SULPHUR
CO2
25
NON-DISTILLABLE LIQUIDS
21
COOLER
WATER
BENZENE
TOLUENE
XYLENE
HEAT MEANS 16
FRESH OIL SHALE
PREHEAT AND PREHYDROGENATION ZONE-10
HYDRORETORT ZONE-11
HYDROGEN PREHEAT ZONE-12
SPENT SHALE (COOLED)

PROCESS FOR PRODUCTION OF HYDROCARBON LIQUID FROM OIL SHALE

CROSS REFERENCE TO RELATED APPLICATIONS

This is a continuation-in-part of co-pending application Process for Production of Hydrocarbon Liquids and Gases from Oil Shale, Ser. No. 409,915, filed Oct. 26, 1973 now abandoned as a continuation-in-part of earlier application Oil Shale Hydrogasification Process, Ser. No. 339,547, filed Mar. 9, 1973, now U.S. Pat. No. 3,891,403.

This invention relates to an improved process for the production of predominately distillable hydrocarbon liquids and low molecular weight paraffinic gases from oil shales. The process of this invention produces liquids of which about 75 percent to about 90 percent are distillable, exhibiting boiling points of below about 720° F. The process of this invention converts more than about 50 percent of the organic carbon in oil shale to predominately distillable liquids and preferred embodiment result in about 75 to about 90 percent of the organic carbon in the oil shale being recovered as the desired liquid product. The hydrocarbon liquids include aliphatic hydrocarbons having open, straight or branched chain molecules which may be saturated or unsaturated and alicyclic hydrocarbons having cyclic molecules substantially free from aromatic double bonds. Low molecular weight paraffinic hydrocarbon gases include molecules of 4 and less carbon atoms, namely methane, ethane, propane, butane and isobutane. The predominately distillable hydrocarbon liquids produced by the process of this invention are especially suited for various further processing. One important use of such liquids is preparing a high methane content pipeline-quality gas suitable as a substitute for or as a supplement to natural gas. Other important uses of such hydrocarbon liquids include production of naphtha, gasoline, kerosene, jet fuel, diesel oil and light fuel oils, and other low boiling distillate oils.

It is well recognized that there is an increasing shortage of petroleum oils in the United States. It is also recognized that oil shales can be a major source of hydrocarbon liquids to supplement the petroleum reserves. However, substantial difficulties are encountered in producing hydrocarbon liquids from oil shale because oil shale contains extremely high molecular weight hydrocarbonaceous material (kerogen) which upon heating has a tendancy to form carbon within the shale and thereby become relatively useless. The conventional methods of usefully removing the organic material from oil shale still leave 20 to 30 percent of the organic material or kerogen with the spent shale in a form of carbon which cannot be reacted by any method other than by burning the organic material as a low grade fuel. The potential shortage of oil and natural gas and of energy, in general, place emphasis on more efficient use of the kerogen in the shale, that is, a greater useful recovery of the hydrocarbons from oil shale is highly desirable.

Oil shales vary in the amount and in the constitution of the organic component which is called kerogen. Typical oil shales contain about 10 to 30 weight percent kerogen, a high molecular weight hydrocarbon with a carbon to hydrogen weight ratio (C/H) typically of about 7/1 to 8/1.

The Fischer Assay Test is a laboratory evaluation test for oil shales based on the retort procedure. In studies by the Bureau of Mines (RI 4825), such retorting leaves behind about 20 percent of the organic carbon in the spent shale. When the retorting is carried out in a hydrogen atmosphere, the process has been referred to as "hydroretorting". In typical processes exemplified in U.S. Pat. No. 3,565,784; 3,617,469 and 3,617,470, the hydroretorting is carried out at several hundred pounds pressure of hydrogen and the shale is brought to and maintained at temperature (700°–1100° F.) for a total of less than three minutes. The resultant shale oil has a greater volume in the hydrotorting process. However, as reported in the patent U.S. Pat. No. 3,565,784, the organic carbon residue is 3.5 percent of the spent shale which corresponds to 20 percent of the original organic carbon according to Bureau of Mines Report, RI 4825.

In another process wherein hydrogen was reacted with oil shale at temperatures suitable for formation of methane (1150°–1360° F.), the shale and hydrogen are rapidly heated to the reaction temperature in a cocurrent manner and the shale is maintained at such a temperature for about ten minutes. In this process, it is preferable to use large hydrogen to shale ratios to achieve low carbon residues. Even then, however, the minimum carbon residue achieved was 13 percent of the original organic carbon in the shale.

Another recent process for the production of pipeline-quality gas from oil shale is set forth in U.S. Pat. No. 3,703,052 wherein both a gasifier and a hydrogasifier are used and circulating solids are used as a heat transfer medium. This process involves rapid retorting of the shale, followed by hydrogasification of the shale oil thereby leaving about 20 percent of the kerogen in the retorted state to be used as a low grade fuel.

To produce a high yield of valuable hydrocarbons from oil shales, it is desirable to limit the coking of the oil shale's organic component and to maximize the production of distillable hydrocarbon liquids from the oil shales. In further processing such hydrocarbons, in turn, give the highest yields of valuable liquid products or fuel gases and cause the least formation of high boiling aromatic oils and carbon or coke during gasification. It is also desired in the production of distillable liquid hydrocarbons from oil shales, to limit decomposition of mineral carbonates present in the oil shale and resultant carbon dioxide formation which increases process heat requirements, comsumption of hydrogen, and increases the difficulty of further processing any gaseous products.

Previous processes for the production of hydrocarbon duels from oil shale have the disadvantages of lower thermal efficiency and/or lower conversion of the organic component oil shale to desirable hydrocarbon liquids.

It is an object of this invention to optimize the production of aliphatic and alicyclic hydrocarbon liquids from oil shale suitable for direct use or further processing.

It is another object of this invention to provide a process for the high yield production of hydrocarbon liquids and hydrocarbon gases from oil shale wherein the oil shale is preheated and prehydrogenated by countercurrent flow of hydrogen-rich gas and then hydroretorted by countercurrent flow of hydrogen-rich gas.

It is still another object of this invention to provide a process for high yield production of pipeline-quality gas having a heating value of 900–1100 BTU/SCF.

Further objects of this invention will appear to one skilled in the art as this description proceeds and by reference to the figures.

Preferred embodiments of this invention are illustrated in the drawing wherein:

FIG. 1 is a block flow diagram illustrating the production of hydrocarbon liquids from oil shale using one embodiment of the process of this invention and with the option of further conversion of such liquids to pipeline-quality gas.

Our experiments have shown that if the shale is properly heated in a stream of hydrogen, it is possible to remove and recover the organic carbon from the shale to a greater extent than previously developed processes. Particularly, it was found that very rapid heat-up of oil shale in the presence of hydrogen to temperatures required for hydroretorting leaves a characteristic minimum amount of carbonaceous residue, in some instances, as much as 12 percent. However, if the same shale is, in the presence of excess hydrogen, brought to temperature slowly, in the order of 20 minutes or longer to go from 600° to 1250° F., the residual carbon will be much less than half that value. Even a 10 minute heat-up period shows significant improvement. Furthermore, if the same principle of slow heat-up is applied to any non-volatile component of the products of the preliminary shale treatment, it is possible to get maximum net conversion of kerogen to hydrogasifiable hydrocarbon liquid.

Referring to FIG. 1, our hydroretorting process of oil shale is illustrated in an extremely simplified diagrammatic form. The reactor includes three major temperature zones. The top portion of the reactor is an oil shale preheat and prehydrogenation zone 10. The second major zone of the reaction chamber is the central portion or hydroretort zone 11. The third major zone in the bottom portion of the reactor is the hydrogen preheat zone 12.

The oil shale useful in our process, is generally the type which is found in the deposits in the northwestern area of Colorado, and in the adjoining areas of Utah and Wyoming. The oil shale which is introduced to top of the reactor has been previously subjected, in a conventional manner, to an oil shale crusher (now shown) for reducing the mined oil shale to the size of pebbles having a diameter in the range of about ¼ to 1 inch. The shale is moved downwardly in the reactor, in the pebble form, in a packed moving bed, or alternatively, in a series of fluidized beds which are heated by the upwardly moving or countercurrent flowing hydrogen-rich gas. The shale moving downwardly in the reactor generally has a velocity range of about 0.2 to 2 feet per minute, and preferably has a velocity of about 1 foot per minute.

The flow rate of the oil shale causes the shale, including the organic material or kerogen therein, to be preheated gradually for at least ten minutes. More specifically, the shale is preferably heated from a temperature of about 600° F. to a temperature of about 700° to about 950° F., preferably about 750° to about 850° F., in a time of at least 10 minutes. At 700° F. the rate of adequate prehydrogenation is slow but may be achieved in several hours, while at 950° F. prehydrogenation occurs in a few minutes, less than about 30 minutes. The recovery of the desired distillable liquids is increased by maintaining the shale at the lower range of temperatures, about 750° to 850° F., for a period of about 1 to 2 hours to obtain pretreatment and prehydrogenation. Therefore, we prefer to slowly heat the oil shale from a temperature of about 600° F. to about 750° to 850° F. over a period of at least 10 minutes and to retain the shale for 1 to 2 hours at about 750° to 850° F.

The oil shale then moves into the hydroretort zone 11 where the temperature is at about 850° to about 1250° F. in order to achieve proper hydroretort conditions. It is desired, in order to obtain the maximum yield of aliphatic and alicyclic hydrocarbon liquids and low molecular weight hydrocarbon gases to maintain the temperature in the hydroretort zone lower than about 1150° F. It is preferred to maintain the temperature in the hydroretort zone at from about 1000° F. to about 1150° F. to obtain yields of predominately distillable hydrocarbon liquids representing conversion of more than 88 percent of the organic carbon in the oil shale. Since the process of this invention is a single countercurrent stream, that is, the gas-liquid stream moves countercurrent to the oil shale and the produced liquid is removed from the upper portion of the hydroretort zone, additional heating above the hydroretort temperature may be desirable to obtain additional organic carbon recovery so long as the higher temperature does not interfere with the prior time-temperature treatment of the shale. The maintenance of the temperature in the hydroretort zone lower than about 1250° F. limits the inorganic carbonate decomposition to acceptable levels and also limits the hydrogenation of organic matter to gaseous paraffinic hydrocarbons called hydrogasification, in the hydroretort zone. Formation of carbon dioxide by inorganic carbonate decomposition in the hydroretort zone is undesirable due to its direct dilution of the hydrogen-rich gas, its consumption of hydrogen in conversion to carbon monoxide and steam, and its use of heat for decomposition. If pipeline-quality gas is ultimately desired, additional purification is required to remove the carbon dioxide and carbon monoxide so formed. However, a small (about 5 percent) amount of carbon dioxide may be useful in that the hydrogen and carbon dioxide will react exothermally in the preheat zone thereby supplying some of the heat at a gradual rate.

Table I shows the effect of temperature in the hydroretort zone upon the decomposition of mineral carbonate under conditions wherein the oil shale was heated at a rate of 33° F. per minute and the original mineral carbonate content of the oil shale was 12.54 weight percent.

TABLE I

| Temperature ° F. | Percent Mineral Carbonate Decomposition |
|---|---|
| 1000 | 0 |
| 1100 | 7.1 |
| 1200 | 13.3 |

Hydrogasification in the hydroretort zone is not necessarily detrimental if the desired product is only fuel gas. At higher temperatures than about 1250° F., increasing proportions of paraffinic hydrocarbon gases are formed which are the most valuable constituents of fuel gases and are the only acceptable major constituents of pipeline-quality gas. However, at temperatures above about 1250° F. the yield of liquid hydrocarbons begins to decrease substantially and the liquids which are produced become increasingly aromatic in composition. Eventually, as temperatures are increased further, the total organic carbon recovery drops to unacceptable levels because of coke and carbon formation of the organic component of the oil shale.

The maximum hydroretorting temperature to obtain a combination of low mineral carbonate decompositions, high total organic carbon recovery and a high proportion of distillable aliphatic and alicyclic hydrocarbons in the hydrocarbon liquid product, is about 1250° F. The preferred temperature range is about 950° to about 1150° F. These temperatures vary somewhat over the specified ranges of hydrogen partial pressure and heat-up rate or retention time.

The hydrogen-rich gas supplied to the hydroretort zone must contain sufficient hydrogen to meet the chemical requirements sufficient to convert the organic portion of the oil shale to aliphatic and alicyclic hydrocarbon liquids and paraffinic hydrocarbon gases. It is desirable to have sufficient excess hydrogen to ultimately convert all of the hydrocarbons recovered and the carbon monoxide remaining after final purification to methane. The use of such an excess of hydrogen in the hydroretort zone also serves to suppress carbon formation and may be a means for providing a portion of the heat necessary to achieve the desired temperature in the hydroretort zone. However, other heating means may be used. The presence of hydrogen in excess of the stoichiometric required amount is desired to provide hydrogen to the preheat and prehydrogenation zone in the single stream countercurrent flow.

The terminology "hydrogen-rich gas" throughout this description and claims, means gases with sufficient hydrogen partial pressure to effect high organic carbon recovery from the organic material in the oil shales. Such hydrogen-rich gases may be obtained by a number of processes well known in the chemical process industry. Table II shows the effect of the hydrogen partial pressure and the heat-up rate upon organic carbon recovery from prehydrogenated oil shales which had an original organic carbon content 21.1 weight percent. The maximum temperature to which the shale was heated was 1150° F.

TABLE II

| Hydrogen at indicated Partial Pressure (psia) | Total Pressure (psia) Heating Rate Hydrogen Content 25% | 50% | 90% | Percent Organic Carbon Recovery at indicated (° F/min.) 10 | 30 | 50 |
|---|---|---|---|---|---|---|
| 0 | Inert gas(500psig Helium) | | | 77 | 77 | 77 |
| 35 | 140 | 70 | 39 | 87 | 87 | 87 |
| 115 | 460 | 230 | 128 | 89 | 87 | 87 |
| 215 | 860 | 430 | 239 | 92 | 88 | 87 |
| 515 | 2060 | 1030 | 572 | 94 | 92 | 88 |

Table II shows that hydrogen-rich gases of 35 psia hydrogen partial pressure are suitable for use in this invention. It is preferred to use hydrogen-rich gas having a partial pressure of hydrogen greater than about 100 psia. The upper operating pressures are limited only by equipment and economic considerations. One benefit of the higher hydrogen partial pressure is that it allows higher rates hence, less residence time and smaller reactors. Total operating pressures throughout the system are usually substantially the same. Normally, the process of this invention may be carried out at total pressures of about 40 to about 1500 psia, preferably about 500 to 1000 psia.

The retention time in the hydroretort zone is sufficient, dependent upon the particular temperature, pressure and hydrogen concentration in the hydrogen-rich gas, to produce by hydroretorting a quantity of distillable aliphatic and alicyclic hydrocarbon liquids and low molecular weight gases from the preheated and prehydrogenated organic components of the oil shale equivalent to a total organic carbon recovery of about 85 percent, and preferably above 90 percent. If the desired end product is pipeline-quality gas, the amount of low molecular weight gases produced in the hydroretort zone is not important. However, when the aliphatic and alicyclic hydrocarbon liquids are going to be further processed to a liquid product, it may be desirable to limit gas formation in this zone by operation in the lower ranges of temperature.

The hydroretort zone may be heated by any suitable method as will be obvious to one skilled in the art. One method is to supply hydrogen-rich gas of as high as possible temperature to raise the temperature of the shale to near the desired temperature by direct thermal exchange. The hydroretort zone may also be internally heated by any suitable means such as fuel oil/oxygen burner or methanation of carbon dioxide as previously described.

Referring to FIG. 1, the fresh oil shale is supplied to preheat and prehydrogenation zone 10 wherein hot hydrogen-rich gas passes countercurrent and in thermal exchange relation to the oil shale at a temperature sufficient to gradually preheat the oil shale to a temperature of about 700° to about 950° F. The preheated and prehydrogenated oil shale is then passed to hydroretort zone 11 wherein it is passed countercurrent in thermal exchange relation with hydrogen-rich gas with sufficient heating to heat the oil shale to a temperature of about 850° to about 1250° F. In hydroretort zone 11, the organic component of the oil shale is destructively distilled to form distillable aliphatic and alicyclic hydrocarbon liquids and low molecular weight paraffinic hydrocarbon gases. The hydrocarbon liquids, remaining hydrogen-rich gas and any newly formed gaseous hydrocarbons may be removed from the hydroretort zone with the hydrogen-rich gas through the preheat and prehydrogenation zone. If necessary, some of the hydrocarbon liquids may be removed before complete cooling to minimize flooding in the shale preheat zone. The hydrocarbon liquids may be subjected to further treatment to form other desired products, such as pipeline-quality gas.

The spent shale is removed from hydroretort zone 11 and passed through heat recovery zone 12 in countercurrent and thermal exchange relation to hydrogen-rich gas which cools the spent shale to less than about 300° F., preferably to about 150° F. The hydrogen-rich gas is heated in heat recovery zone 12 for passage to hydroretort zone 11. One advantage of the process of this invention is the high thermal efficiency wherein the hydrogen-rich gas may remove a large portion of the thermal energy of the spent shale for reutilization in the the process.

FIG. 1 shows a preferred embodiment of this invention wherein hydrogen-rich gas from preheat and prehydrogenation zone 10 passes through separator 13 for removal of liquids, namely water and hydrocarbon liquids formed in the reactor. The organic hydrocarbon liquids from separator 13 may be fed into liquid separator 18 wherein the light hydrocarbon liquids are the primary product or, if pipeline gas is desired, the light liquids alternatively are fed to hydrogasifier 20. The heavy non-distillate liquids may be utilized as fuel or in hydrogen generator 19 for producing make-up hydrogen or fed through control valve 25 back into the lower portion of the shale preheat zone 10 for recycling in the hydroretort zone 11.

The stream of hydrogen-rich gas from separator 13 is recycled to heat recovery zone 12. An amount of gas is bled off through control valve 24 to prevent contaminant build-up and may be utilized in hydrogen generator 19 and/or in hydrogasifier 20. The amount of hydrogen-rich gas make-up is determined by the amount of hydrogen consumed in the prehydrogenation and hydroretort zones. The hydrogen-rich gas is heated in heat recovery zone 12. However, to raise the temperature of the hydroretort zone to the desired temperature, heat input means 16 is used. The heat input means may be combustion of fuel with oxygen.

The advantages of the process of this invention are achieved by the controlled gradual preheating and prehydrogenation in zone 10 followed by higher temperature hydroretorting of the preheated and prehydrogenated oil shale in zone 11. While prior processes of retorting oil shale without gradual preheating and prehydrogenation of the organic component have resulted in less than 80 percent recovery of the organic carbon from the shale, we have found that with our two-zone process, it is possible to recover as much as about 95 percent of the organic carbon from the oil shale.

One important use for the hydrocarbon liquids obtained from the hydroretort zone by the process of this invention, is for further processing to produce pipeline-quality gas. Pipeline-quality gas may be obtained from such readily gasifiable liquids by any suitable method of producing a methane-rich gas. The hydrocarbon liquids may be further treated to produce pipeline-quality gas by many known processes including hydrogasification by gas recycle hydrogenation or fluidized bed hydrogenation, naphtha reforming, catalytic-rich gas, methane-rich gas or Lurgi Gasynthan processes.

One method of pipeline-quality gas production is shown in FIG. 1 where the effluent gas from hydrogasifier 20 is then passed through condenser-cooler 21 removing water, benzene, toluene, xylene followed by purification in purifier 22 to remove any remaining quantities of undesired steam, carbon monoxide, carbon dioxide, hydrogen sulfide, and ammonia. Following such purification, the hydrogasified product is methanated in a conventional methanator 23 to increase the amount of methane in the resulting pipeline-quality gas.

Suitable apparatus for use in the process of this invention will be readily apparent to one skilled in the art. It is apparent that the process of this invention may be operated in a physically separated preheat and prehydrogenation zone, hydroretort zone and hydrogen preheat zone or the three zones may be physically contained in one vessel appropriately separated or they may be one physical volume with the required temperature gradient. When operated on a batch basis, the preheat and prehydrogenation conditions may first be subjected to a single zone to which same zone the hydroretort conditions are later applied. It is readily apparent the process of this invention may be carried out on either a batch or continuous flow basis. A continuous flow process such as a series of fluidized beds, is preferred.

While no specific means of distribution of the hydrogen-rich gas throughout the zones containing oil shale is shown, it is readily apparent that it is desirable to have a suitable gas distribution means such as a gas manifold distribution system at the introduction area of the gas to the particular zone. The desirable factor is that the hydrogen-rich gas be effectively distributed to the cross-sectional area of the zone upon its introduction or shortly thereafter.

Suitable materials for construction of an apparatus suitable for the process of this invention are well known to persons skilled in the art and need only be sufficient to contain the pressures obtained in the process and to effect suitable heat retentions in the different thermal zones of the process of this invention.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A process for the production of predominately distillable aliphatic and alicyclic hydrocarbon liquids from kerogen containing oil shale wherein above about 77 percent of the organic carbon in said oil shale is converted to liquids and gases and there is minimal carbon residue formation resulting from the conversion of kerogen to the hydrocarbon liquids comprising the steps:

introducing fresh oil shale into a preheat and prehydrogenation zone;

gradually preheating oil shale in the preheat and prehydrogenation zone at a rate to provide at least ten minutes to heat the oil shale from a temperature of 600° F. to a temperature of about 700° to about 950° F. in the presence of hydrogen-rich gas which inhibits the formation of carbonaceous residue;

hydroretorting the preheated and prehydrogenated oil shale in a hydroretort zone at a temperature of about 850° to about 1250° F. in the presence of hydrogen-rich gas containing stoichiometric required amounts and greater of hydrogen to form predominately distillable aliphatic and alicyclic hydrocarbon liquids from the preheated and prehydrogenated organic portion of said oil shale, said hydrogen-rich gas passing sequentially through said hydroretort and preheat and prehydrogenation zones in a single stream countercurrent to said shale and maintaining the hydrogen partial pressure in the preheat and prehydrogenation zone and in the hydroretort zone at a pressure of more than 35 psia;

removing the hydrogen-rich gas and distillable aliphatic and alicyclic liquids from the preheat and prehydrogenation zone and separating the aliphatic and alicyclic product liquids from the hydrogen-rich gas.

2. The process of claim 1 wherein spent shale is passed from said hydroretort zone to a heat recovery zone wherein hydrogen-rich gas recycled from said preheat and prehydrogenation zone passes countercurrent and in thermal exchange relation to said spent shale cooling the spent shale and heating the hydrogen-rich gas for introduction to said hydroretort zone.

3. The process of claim 2 wherein said preheat zone, said hydroretort zone, and said heat recovery zone are in the upper portion, central portion and lower portion respectively of one chamber.

4. The process of claim 2 wherein hydrogen-rich gas make-up is added to said hydrogen-rich gas recycle prior to introduction to said heat recovery zone.

5. The process of claim 1 wherein the oil shale is preheated to about 750° about 850° F. in said preheat and prehydrogenation zone and retained for 1 to 2 hours at about 750° to about 850° F. to complete pretreatment and prehydrogenation.

6. The process of claim 1 wherein the preheated and prehydrogenated oil shale is heated to about 950° to about 1150° F. in said hydroretort zone.

7. The process of claim 6 wherein said temperature is about 1000° to about 1150° F. thus producing yields of predominately distillable hydrocarbon liquids representing conversion of more than 88 percent of the organic carbon in the shale.

8. The process of claim 1 wherein said shale is heated gradually from inlet temperature to said hydroretort temperature in a period of about 10 to 120 minutes.

9. The process of claim 1 wherein the preheated and prehydrogenated shale in the hydroretort zone is heated by an internal heating means.

10. The process of claim 1 wherein the preheat and prehydrogenation zone and the hydroretort zone is at a total gas pressure of about 40 to about 1500 psia.

11. The process of claim 10 wherein the hydrogen partial pressure is greater than about 100 psia.

12. The process of claim 3 wherein said hydrogen is passed through said chamber in more than stoichiometric amounts.

* * * * *